United States Patent [19]

Staudt et al.

[11] 3,963,014

[45] June 15, 1976

[54] FUEL INJECTION PUMP FOR INTERNAL COMBUSTION ENGINES

[75] Inventors: Heinrich Staudt, Markgroningen-Talhausen; Wolfgang Eckell, Gebersheim; Hartmut Lehmann; Karl Sontheimer, both of Stuttgart; Eberhard Hofmann, Kirchberg-Murr, all of Germany

[73] Assignee: Robert Bosch G.m.b.H., Stuttgart, Germany

[22] Filed: Sept. 24, 1974

[21] Appl. No.: 508,892

[30] Foreign Application Priority Data

Oct. 2, 1973 Germany ..... 2349366

[52] U.S. Cl. ..... 123/139 R; 277/102; 123/139 AA

[51] Int. Cl.[2] ..... F02M 39/00

[58] Field of Search ..... 123/139 R, 139 AA; 277/102, 173; 123/190 C

[56] References Cited

UNITED STATES PATENTS 1,953,449 4/1934 Thege ..... 123/139 R 3,667,437 6/1972 Dreisin ..... 123/139 R

*Primary Examiner*—Charles J. Myhre
*Assistant Examiner*—Ronald B. Cox
*Attorney, Agent, or Firm*—Edwin E. Greigg

[57] ABSTRACT

A fuel injection pump for internal combustion engines includes a housing, which defines an elongated chamber, within which serial pumps including, in respective cylinders, pump pistons driven by a cam shaft via respective cams. The elongated chamber is closed by a single cover. A seal is provided between the cover and the housing by an O-ring tightened between an offset provided on the circumference of the cover and an inwardly facing wall of the housing. The offset provided on the circumference of the housing is so shaped, along its surface facing the inwardly facing wall of the housing that the O-ring is primarily stressed axially, with respect to the direction of fastening of the cover, along two sections which extend in the longitudinal direction of the cover and that the O-ring is primarily stressed radially in the region of the housing adjacent to end walls of the housing.

9 Claims, 7 Drawing Figures

FUEL INJECTION PUMP FOR INTERNAL COMBUSTION ENGINES

BACKGROUND OF THE INVENTION

This invention relates to a fuel injection pump for internal combustion engines, especially multi-cylinder serial pumps which include pump pistons driven by cam shaft via cam means. The present invention relates, more particularly, to such pumps having a chamber within its housing, the chamber having the shape of an elongated recess and having an opening. A single cover is provided over the opening, and a sealing means is positioned between the housing and the cover, the sealing means including an O-ring which is tightened between an offset on the circumference of the cover on a seat defined by a receiving bore. The receiving bore is provided at a transition between the chamber and the outer surface of the housing.

Known fuel injection pumps of the above-described construction, wherein a single cover closes a downwardly opening chamber within the housing intended to receive a cam shaft, usually have an O-ring seal between the cover and the housing. The seat for the O-ring is formed in known manner, customary in a machine, by a 45° beveling at the transition between the housing chamber and the bottom surface of the pump housing. Covers, or more precisely, bottom closing covers of the above-described kind require, for good sealing and for producing an appropriate compressing stress in the O-ring as well as for satisfactory contact with the bottom surface of the pump housing that both in their transverse as well as longitudinal extent, the edge of the housing extends beyond the housing itself and beyond the O-ring seat. The length of the cover directly affects the total construction length of the pump because the thickness of the frontal walls of the pump, which are longitudinally adjacent to the attachment region for the cover, is predetermined by the necessary constructional volume of the cam shaft bearing and by the wall thickness of frontal attachment flanges of the pump. The wall thickness is subject to conditions of rigidity and cannot fall below a minimum dimension. These conditions of constructional volume are especially critical if, in order to reduce the constructional height of the pump, the cover is mounted at the shortest possible distance from the cam shaft.

SUMMARY OF THE INVENTION

It is the principal object of the present invention to provide an improved fuel injection pump of the above-described construction which has a closing cover for the housing chamber which does not, or only insignificantly, influence the total length of the pump.

The total length of the pump, constructed according to the present invention, is determined only, for example, by the greatest distance between the first and last plunger, or more precisely by the maximum extent of the associated guide bores plus the thickness of the two frontal flanges or frontal walls of the pump housing. In all this, consideration must be given to the requirements of mass production and a satisfactory seal and easy attachment of the cover must be assured.

The foregoing object, as well as others which are to become apparent from the text below, are achieved according to the present invention in a fuel injection pump for internal combustion engines, especially for multicylinder serial pumps which include pump pistons driven by a cam shaft, via respective cams, wherein a chamber is provided within a housing, the chamber having an opening in the shape of an elongated hole which can be covered by a single cover. A seal is included between the pump housing and the cover, the seal being provided by an O-ring which is tightened between an offset on the circumference of the cover and a receiving seat at the transition between the inner surface of the housing defining the chamber and the outer surface of the pump housing. The O-ring is inserted, parallel to two section of the offset which extend in the longitudinal direction of the cover, in two step-shaped offset extensions of a receiving seat. In the vicinity of these extensions the O-ring is stressed primarily axially, in the direction of fastening of the cover. The O-ring is stressed primarily radially in the region of walls of the housing which lie adjacent to end faces of the pump housing.

In a more detailed variant, the fuel injection pump according to the present invention has its O-ring stressed both axially and radially in transition regions between the extensions and frontal walls of the housing where, in at least one location of each transition region, there exists an uninterrupted sealing surface in going from the axial seal toward the radial seal.

This hybrid seal combining axial and radial sealing as used in the combination according to the present invention has the advantages of both types of sealing without having their disadvantages. In the entire following description, an axial seal will be referred to as one whose sealing member is put under compression stress in a direction corresponding to the fastening direction of the cover and a radial seal will be referred to as one which is compression stressed at sustantially right angles to the fastening direction. A seal which is stressed only axially between the cover and the pump housing would have the disadvantage that the required offset for receiving the sealing ring and also the rim of the cover would disadvantageously extend the total length of the pump, whereas an exclusively axial seal between the pump housing and the cover would require compression forces so great that the cover could not be inserted without difficulty and would require accessory tools. In the combination according to the invention, the compression forces stresses due to the radial sealing occur only in regions of limited extent of the cover, and these regions may be made very short with respect to the total sealing length. This has the advantage that the largest part of the seal, especially at the long sides of the cover, is stressed only axially. Thus, the cover can be installed easily by hand without supplementary tools. The radial stress at the two ends of the cover produces a so-called snap-action which keeps the cover in the position it has once assumed; this simplifies the assembling of the pump considerably. What is also very important is that there exist a uninterrupted sealing surface in the transition regions between the axial and radial stressed regions, otherwise leaking fuel or leaking oil could seep through the transition regions.

Fuel injection pumps are also known in which a short constructional length is achieved in the same way in that, as an extension of each locating bore of the plunger, in the bottom of the pump housing, there is provided, corresponding to the locating bore, a mounting bore which is closed by a closing cap or screw. These injection pumps have the disadvantage however, that a separate closing member is required for each pump element and must be separately sealed. Another important disadvantage is that the chamber, defined by the interior of the housing, containing the cam shaft cannot be constructed so as to be open downwardly which makes it impossible to produce the pump housing using die casting techniques and when it is made in a permanent mold casting process, cores must be provided for the partially enclosed chamber defined by the interior of the housing.

In embodiments of the present invention, it is possible to provide that the maximum necessary distance between the frontal walls of the chamber which define the radial sealing surface for the O-ring is equal to or only slightly greater than the distance of the guide bore for the plungers.

Except for a small bevel to enable the damage-free introduction of the O-ring and possibly a separation of a few tenths of a millimeter from the guide bore which should be present for safety reasons so as to account for manufacturing tolerances, the housing chamber and hence, also the cover, does not require any additional constructional space which would extend beyond the greatest extent of the guide bores for the piston operating plungers. Now, if in such an embodiment of the subject of the invention, the radial sealing surface is located exactly as an extension of the outermost limit of the guide bore, then, at this point, the O-ring no longer has any support in the axial direction, i.e., in the direction of mounting the cover. But, since this region is very narrow, it does not result in disadvantages.

In a preferred varient of the embodiments of the present invention, the sealing surfaces of the step-shaped extensions are inclined in the direction of the chamber. The sealing surfaces of the step-shaped extensions are preferably inclined with respect to the outer surface of the pump housing at an angle of inclination of approximately 30°.

This inclination increases the deformation space for the O-ring and it therefore, makes it less sensitive to construction tolerances and, in the transition regions between the axial and radial sealing regions, it simplifies the required information of an uninterrupted sealing surface, because otherwise leaking fuel or leaking oil could seep out in these transition regions.

According to a preferred feature of the present invention, the cover is held in its installed position by clamping dogs.

The clamping dogs each have an end which fixedly attaches to the outer surface of the pump housing at the rim of the chamber. Each dog has a second end which extends into the bore which receives the cover, which provides a seat therefor, and is supported by the rim on the cover defined by the offset.

In this way, a precisely defined mounting pressure of the cover and stressing of the O-ring may be achieved.

The ends of the clamping dogs which extend into the bore which receives the cover is desirably angled toward the cover.

Thus, in an advantageous manner, the cover may be pressed down somewhat in order to thus create space for a bevel at the transition from the sealing location to the outer surface of the pump housing for easing introduction of the round sealing ring.

The fuel injection pump according to a second preferred embodiment is provided with step-shaped extensions which provide seating surfaces for the O-ring, the extensions becoming uniformly narrower in the direction of the frontal walls of the chamber, but which, at the narrowest location within the region of the radial seal, still form an edge which is at least a few tenths of a millimeter wide.

This edge supports the formation of a continuous sealing surface and when the axes are displaced or misaligned due to manufacturing conditions, it prevents an intersection of the plunger bore and the wall of the housing which would break the continuous sealing surface in the region of the frontal walls.

Of course, the invention is not limited to application in bottom closing covers for fuel injection pumps, but it may be used whenever it is important to create a reliable seal and easy assembly and manufacture together with a small axial extent of the cover.

BRIEF DESCRIPTION OF THE DRAWING

Two exemplary embodiments of the fuel injection pump according to the present invention are illustrated in the drawing.

DESCRIPTION OF THE PREFERRED EMBODIMENTS

Figure 1:
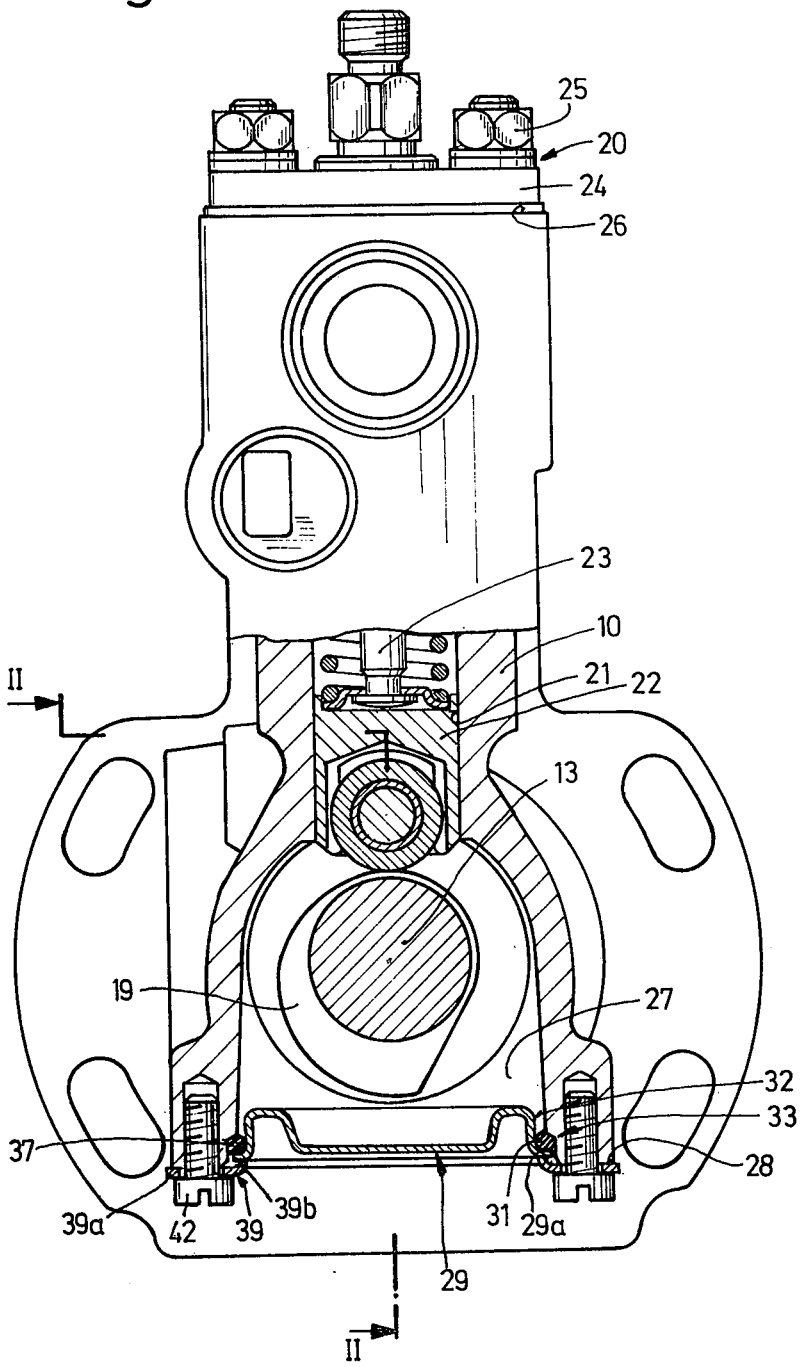
FIG. 1 is a partially sectional view of one face of the fuel injection pump according to a first exemplary embodiment, the section being taken along line I—I in FIG. 2.
Figure 2:
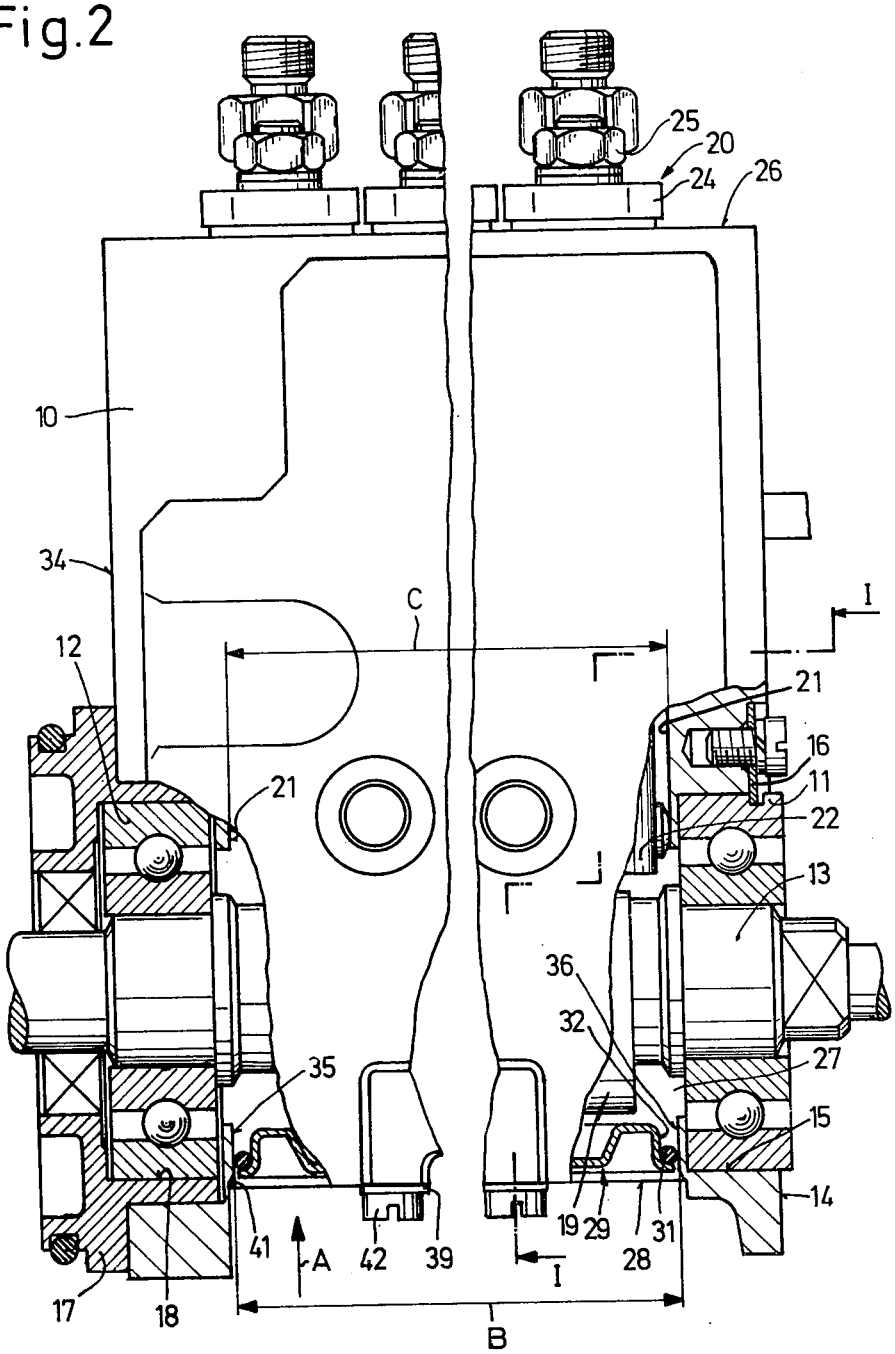
FIG. 2 is a side, partially sectional view of the pump shown in FIG. 1, the section being taken along line II—II in FIG. 1.
Figure 3:
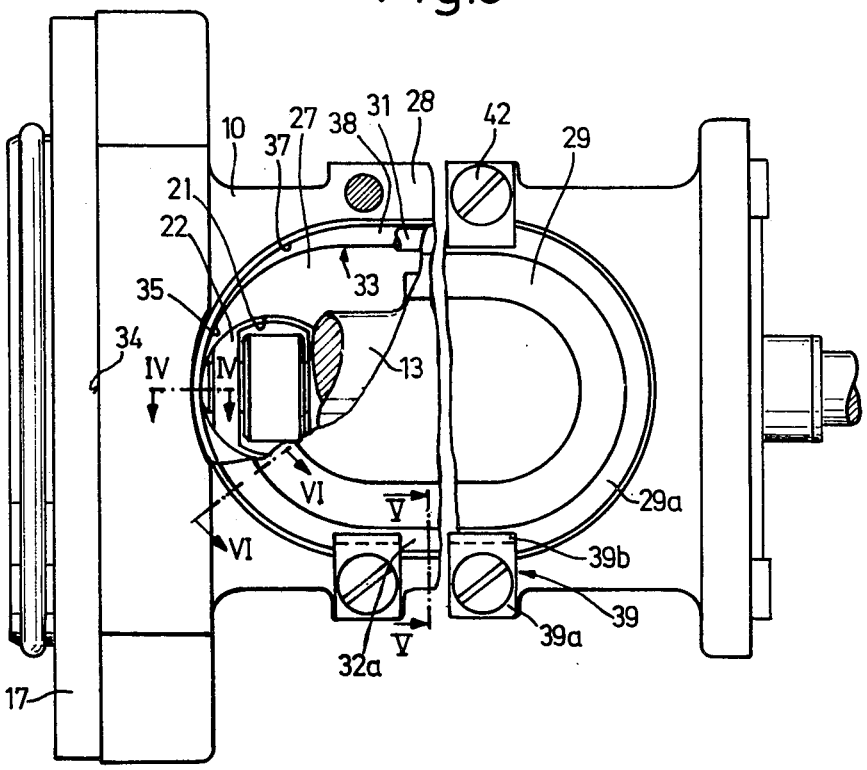
FIG. 3 is a bottom view of the pump shown in FIGS. 1 and 2, the viewing direction being indicated by the arrow-headed line A in FIG. 2.

As illustrated in FIGS. 1–3, a fuel pump according to the first embodiment of the present invention includes a pump housing 10 of a multi-cylinder serial injection pump. Two bearings 11 and 12, in which a cam shaft 13 is rotatably supported, are fixed at opposite ends of the pump housing 10. The bearing 11 is directly mounted in a mounting bore 15 in a frontal region of the pump housing 10 defined by a frontal wall 14, and is secured in this position by three safety clips 16 equally displaced by 120°. The other bearing 12 is located in a bearing flange 17 which is itself inserted in a bore 18 of the pump housing 10. In known manner, the cam shaft 13 is equipped with cam lobes 19 which actuate plungers 22 which are guided in guide bores 21 and actuate pump pistons 23. The pump pistons 23 are guided in known manner, not further shown, within cylinder bushings 20 which are themselves inserted into the pump housing 10. In the first exemplary embodiment, the cylinder bushings 20 are flange bushings having mounting flanges 24 and which are tightened by screws 25 against an upper face 26 of the pump housing 10, as best seen in FIGS. 1 and 2.

The cam shaft 13 is surrounded by space defining an elongated chamber 27 (FIGS. 1 and 3), which, when seen in the direction of arrow A (FIG. 2) has the form of an axially extended elongated recess, whereas in the section visible in FIG. 1 it has the shape of a downwardly open "U" and which is closed off at its sole bottom openings 28, serving as the lowest extent of the pump housing 10, by a single cover 29 stamped from sheet metal. With the aid of an O-ring 31, the cover 29 serves to seal off the chamber 27, which contains lubricating oil or fuel for lubricating the movable parts and the bearings of the pump. The O-ring 31 is tightened between an upstanding offset 32 at the circumference of the cover 29 and a seating surface defined by a receiving bore (seat) 33 (FIG. 1) located at a transition between the chamber 27 and the bottom surface 28 of the pump housing 10. The seal effected by the O-ring 31 constitutes a hybrid seal as between an axial and a radial seal which is very clearly seen from the enlarged sectional representations of those portions of the fuel injection pump shown in FIGS. 4 through 6. Within the region of the section according to IV—IV in FIG. 3 (see FIG. 4), the O-ring 31 is compressively stressed only radially. This stress occurs between the offset 32 of the cover 29 and a frontal wall 35 of the chamber 27 lying adjacent to a frontal wall 34 of the pump housing 10 in which the bearing flange 17 is mounted. The same conditions, in mirror image orientation, are found on the opposite extent of the cover 29 as between the offset 32 of the cover 29 and a frontal wall 36 of the chamber 27 adjacent to the frontal wall 14 (see FIG. 2). The largest extent of the large sealing ring 31, however, is compressively stressed axially or is at least, substantially stressed axially. Thus, the O-ring 31 is inserted parallel to two regions 32a of the offset 32 extending in the longitudinal direction of the cover 29 and it is placed in two step-like extensions 37 of the seating surface 33. As is clearly shown in the enlarged representation of FIG. 5, a portion 38 of the seating surface defined by the bore 33 of the step-shaped extensions 37 is inclined toward the interior of the chamber 27. It has been shown to be advantageous if the seating surfaces 38 of the step-shaped extensions 37 are inclined with respect to the bottom surface 28 of the pump housing 10 by an inclination angle of 30°. This produces radial components of the force acting on the O-ring 31 from the seating surface portion 38 and these radial forces uniquely determine the location and shape of the O-ring 31 with respect to the regions **32*a* on the cover 29. Thus, the installation space for the O-ring 31 is made more advantageous and less sensitive to tolerances than would be the case for a flat seating surface parallel to the bottom surface 28. In the first exemplary embodiment according to FIGS. 1 through 6, the seating surface portions 38 become uniformly narrower toward the frontal walls 35 and 36 until they are virtually zero in the region of the outermost extent of the the frontal walls 35 and 36**.

Figure 6:
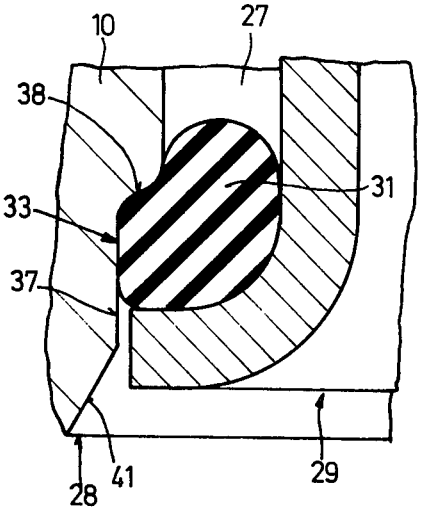

FIG. 6 is an enlarged representation of a section taken along line VI—VI in FIG. 3 which shows that in the transition region shown here, between the step-shaped extensions 37 and the frontal walls 35 and 36 of the seating surface defined by the bore 33, the O-ring 31 is stressed both axially and radially and, at least at one place about its radial circumference in each of these transition regions has an uninterrupted sealing surface as it passes from the axial to the radial stressed sealing regions.

Figure 4:
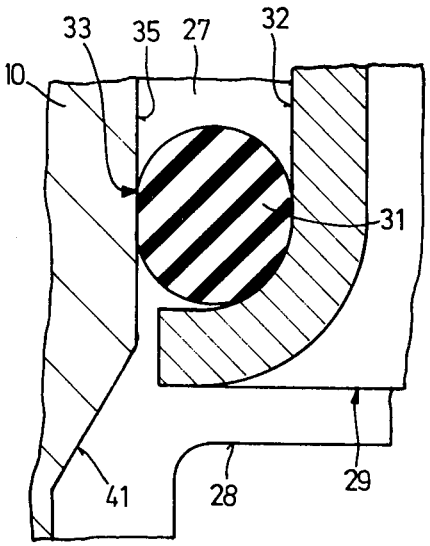
FIGS. 4 through 6 are enlarged sectional representations of the fuel pump shown in FIGS. 2–3, the sections being taken respectively along lines IV—IV, V—V and VI—VI in FIG. 3 through the O-ring of the first exemplary embodiment, FIGS. 5 and 6 showing views rotated into a plane corresponding to that of FIG. 4.
Figure 5:
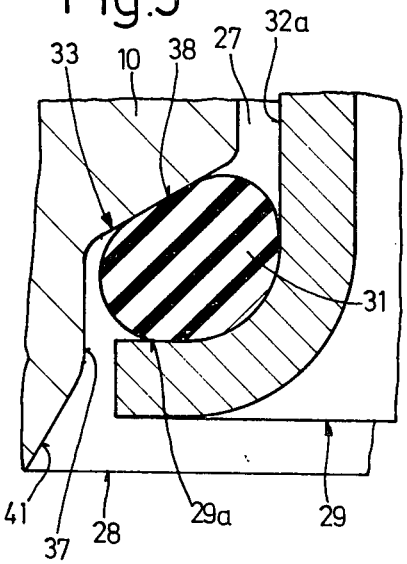

As may be seen from FIGS. 2 and 4, the O-ring 31 does not have any axial support of any kind within the region of the radial seal in the first exemplary embodiment. However, in the present case, this is not disadvantageous because this region is relatively narrow. This hybrid sealing arrangement according to the present invention, consisting of a combination of radial and axial seals, achieves an advantage which has not been achieved with any other construction, namely that, when a housing chamber is downwardly open, a seal may be achieved with only one single cover which does not unfavorably influence the construction length, i.e., does not increase it. The maximum distance, B in FIG. 2, between the sections of frontal walls 35 and 36 which form the radial sealing surfaces for the O-ring 31 is the same or only a few tenths of a millimeter larger than the distance C between the maximum extents of the guide bores 21 for the plungers 22. The axial stress of the O-ring 31 is obtained in that the cover 29 is held in its installed position by clamping dogs 39 whose one end **39*a* fixedly attaches to the bottom surface 28 of pump housing 10 at the edge of the chamber 37 and whose other end 39*b*, which extends into the receiving bore 33 for the cover 29 is supported by a rim 29*a* provided on the cover 29 formed by the offset 32. The ends 39*b* of the clamping dogs 39 which extend into the receiving bore 33 for the cover 29 are inclined toward the cover 29. The length of these inclined ends 39b exactly determines the position of the cover 29 and the dimensions of individual parts are so chosen that an effective and satisfactory seal is provided. So as not to damage the O-ring 31 when it is first inserted into the receiving bore 33, the receiving bore 33 is provided with an insertion bevel 41 along its entire circumference as well as in the region of the extensions 37 and in the region of the frontal walls 35 and 36**.

The very small extent of the exclusively radial seal at the frontal walls 35 and 36 of the chamber 37 brings another advantage, in addition to the diminution of the constructional space in the longitudinal direction of the pump. This additional advantage is a more favorable possibility for mounting and assembling than would be the case with a purely radial seal. With a purely radial seal along the entire circumference of a cover, it would not be possible without supplementary tools and considerable effort to provide the required insertion force. In the present case, however, one obtains an advantageous "snap effect", which permits the cover 29 to fall into its insertion position and to be held there.

Figure 7:
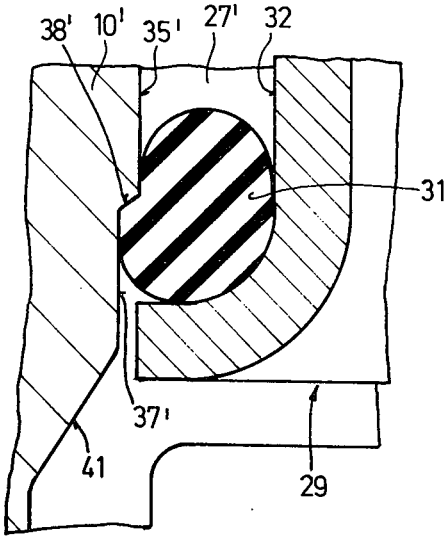
FIG. 7, which is a view similar to that of FIG. 4, illustrates a second exemplary embodiment of a fuel pump according to the present invention, the remaining features of the second embodiment corresponding to those shown in FIG. 2.

The second exemplary embodiment is differentiated from the first exemplary embodiment shown in FIGS. 1 through 6 only by the somewhat altered construction of the radial seal within the region of the frontal walls 35 and 36 of the housing 10. Thus, the sense of FIGS. 1, 2, 3, 5 and 6 is also valid for the second exemplary embodiment and the radial seal, which is different from the first exemplary embodiment, as illustrated in FIG. 4 has been shown in FIG. 7. A pump housing 10' of the second exemplary embodiment has stepshaped extensions 37' which, just as was the case for the step-shaped extension 37 of the first example, has sealing support surfaces 38' for the O-ring 31, these support surfaces 38' becoming uniformly narrower in the direction of walls 35' of a chamber 27', but, even at their smallest point in the region of the radial seal, they still have an edge whose width is at least a few tenths of a millimeter (on the average 0.6 mm). This embodiment is distinguished with respect to the first exemplary embodiment by the advantage that the manufacturing tolerances which are unavoidable in mass production cannot lead to damage of the extensions 37' for receiving the O-ring 31 when the guide bore 29 for the plunger 22 is machined. The edge, whose width is at least a few tenths of a millimeter and which remains even in the region of the radial seal (FIG. 7) so well assures that these machining errors cannot cause harm that the pump housing 10' can be manufactured, for example, using a diecast technique, including even the finished cast chamber 27' and the cast-in extension 37' for receiving a sealing O-ring 31. The cover 29 is identical to the cover used in the first exemplary embodiment. Since receiving surfaces 38' are present over the entire circumference to be sealed by the cover 29 and the O-ring 31, and they experience no interruption, they produce a continuous sealing edge which, in addition to the transition region shown in FIG. 6, offers an added feature for avoiding leakage of fuel. The installation of the cover 29 occurs in both exemplary embodiments as set out below.

The O-ring 31 is pulled over the regions 32a of the offset 32 of cover 29 prior to the insertion thereof and to an extent that it locates itself into the hollow throat or corner formed by the regions 32*a* and the rim 29*a* which is provided with a radius. Afterward, the cover 29, including the positioned O-ring 31, is pressed into the extension 37 or the extension 37' making use of the introduction bevel 41. Only in the region of the radial seal (FIGS. 4 and 7) does the O-ring 31 experience compression during insertion and this compression occurs in the radial direction, i. e., a direction perpendicular to the housing frontal wall 35 or 35' or 36. Because these regions are very narrow, the cover 29 may be inserted by hand into the bore 33 without supplementary tools and is held in a position in which the O-ring 31 lies on the seating surfaces 38 or 38' of extension 37 or 37'.

The clamping dogs 39 are then mounted and are tightened by screws 42. In that step, the ends 39*a* of the clamping dogs 39 fixedly attach to the bottom surface 28 of the pump housing 10 or 10'. The ends 39*b* angled toward cover 29 presses on the rim 29*a* of cover 29 and holds the latter in its installed position. The tolerances for the position of the seating surfaces 38 or 38' of the bore 33 for the O-ring 31 are so chosen that, even if these tolerances are unfavorable, a satisfactory seal is achieved. However, if the choice of these tolerances of the individual constructional members should be difficult, it would be possible, very simply, to dimension the parts so that they guarantee a flawless seal at some precise torque of the screws 42 if an inclined position of the clamping dogs 39 is acceptable.

It is to be appreciated that the foregoing description and accompanying figures of drawing relate to exemplary embodiments set out by way of example, not by way of limitation. Numerous other embodiments and varients are possible within the spirit and scope of the invention, the scope being defined in the appended claims.

What is claimed is:

1. In a fuel injection pump for internal combustion engines, especially multi-cylinder serial pumps which include pump pistons driven by a cam shaft via cam means, the pump having a chamber within its housing which is in the shape of an elongated recess having side walls, frontal walls and an opening, a single cover over the opening and a sealing means between the housing and the cover, the sealing means including an O-ring, having first and second portions which is tightened between an offset on the circumference of the cover and a seat, defined by a receiving bore, in a region between the chamber and the outer surface of the housing, the improvement comprising two sections of said offset extending in the longitudinal direction of said cover and said seat including two step-shaped extensions, first portions of said O-ring being positioned parallel to said two sections adjacent said extensions, said O-ring being primarily axially stressed in the direction of fastening of said cover between said cover and said extensions; second regions of said O-ring being positioned adjacent said frontal walls and being primarily radially stressed between said cover and said frontal walls; whereby said step-shaped extensions and said frontal walls define transition regions and portions of said O-ring lying adjacent said transition regions are stressed both axially and radially.

2. An improved fuel injection pump according to claim 1, wherein said transition regions between said extensions and said frontal walls of said housing provide an uninterrupted sealing along said O-ring.

3. An improved fuel injection pump according to claim 1, wherein the distance between those portions of said frontal walls of said chamber which form radial sealing surfaces for said O-ring is at most only slightly greater than the length of guide bores for said plungers.

4. An improved fuel injection pump according to claim 1 wherein said step-shaped extensions provide seating surfaces for said O-ring which become uniformly narrower in the direction of said frontal walls of said chamber, but which, at the narrowest location within the regions of radial seal, still form surfaces which are at least a few tenths of a millimeter wide.

5. An improved fuel injection pump according to claim 1, wherein sealing surfaces of said step-shaped extensions are inclined in the direction of said chamber.

6. An improved fuel injection pump according to claim 5, wherein said sealing surfaces of said step-shaped extensions are inclined, with respect to an outer lowest most surface of said pump housing at an angle of inclination of approximately 20°.

7. An improved fuel injection pump according to claim 1 including a plurality of clamping dogs, said cover being held in its installed position by said clamping dogs.

8. An improved fuel injection pump according to claim 7, wherein said clamping dogs each have a first end which is fixedly attached to an outer lowest most surface of said pump housing at the edge of said chamber, each of said dogs having a second end which extends into a bore which receives said cover and which is supported by the rim of said cover formed by said offset 32.

9. A fuel injection pump according to claim 8, wherein each of said second ends of said clamping dogs, which extends into said bore for receiving said cover, is angled toward said cover.

* * * * *